United States Patent [19]

Yarbrough et al.

[11] Patent Number: 4,853,677

[45] Date of Patent: Aug. 1, 1989

[54] PORTABLE INTRUSION ALARM

[76] Inventors: Alfred E. Yarbrough, 1194 Hondo, DCBE, Granbury, Tex. 76048; Jerry O. Ball, 6315 Rosemont, Fort Worth, Tex. 76116

[21] Appl. No.: 221,615

[22] Filed: Jul. 20, 1988

[51] Int. Cl.[4] ..... G08B 13/20

[52] U.S. Cl. ..... 340/544; 340/550; 340/566; 340/545

[58] Field of Search ..... 340/550, 566, 522, 544; 381/56

[56] References Cited

U.S. PATENT DOCUMENTS 3,543,261 11/1970 Burney ..... 340/566
4,134,109 1/1979 McCormick ..... 340/550
4,206,451 6/1980 Kurschner ..... 340/522
4,307,387 12/1981 Baxendale ..... 340/550
4,386,343 5/1983 Shiveley ..... 340/550
4,668,941 5/1987 Davenport ..... 340/550

*Primary Examiner*—Joseph A. Orsino
*Assistant Examiner*—Hollis Chen
*Attorney, Agent, or Firm*—Finnegan, Henderson, Farabow, Garrett and Dunner

[57] ABSTRACT

An intrusion alarm system, for an enclosed space responsive to frequencies in the one to two Hertz range for detecting opening of doors or windows; and responsive to frequencies in the three to four Khz range for detecting breaking glass. A detected frequency in the one to two Hertz range increases the sensitivity required for detecting breaking glass.

13 Claims, 3 Drawing Sheets

10
M
12
HIGH FREQUENCY BANDPASS FILTER 3K-4K
18
110
ADJUSTABLE GAIN AMPLIFIER
20
120
INTEGRATOR DETECTOR CIRCUIT
22
48
49
COMP.
24
ONE SHOT
26
142
OR
36
SENSITIVITY CIRCUIT
50
96
58
AMPLIFIER
28
70
LOW FREQUENCY BANDPASS FILTER 1-3 HERTZ
30
46
COMP
32
80
ONE SHOT
34
86
44
A
42
166
P.C. NOISE FILTER
54
D.C. REGULATOR
52
-8V
+12V
168
60

PORTABLE INTRUSION ALARM

FIELD OF THE INVENTION

This present invention relates to intrusion alarms; and more particularly, to a portable intrusion alarm for indicating the violation of an enclosed space.

BACKGROUND INFORMATION

Personal portable, intrusion alarm devices have become relatively popular in recent years. They can be used in one's permanent place of abode, in place of, or as a supplement to a permanently installed alarm system. Such portable alarm devices are widely used to provide a warning of unauthorized intrusion in places other than one's permanent home, such as hotel rooms, vacation homes, motor homes and boats, to mention a few examples.

There are several different types of intrusion alarm systems. Some have sensors that are fastened to a door or window which sound an alarm when the door is opened or the window raised. These systems typically require that the sensors be properly installed or attached to the window or door as the case may be. Other systems utilize electromagnetic fields or ultrasonic transducers, for example, that detect the presence of a person in the room. This type of system is also effective for certain applications, but only in areas where persons or animals are not normally present.

More recently, portable systems have been proposed that are sensitive to noise and/or to changes in ambient air pressure. Such systems have been found effective for certain applications but tend to be prone to false alarms, such as those caused by traffic noises, barking dogs, or other unexpected, but harmless, noises, for example.

SUMMARY OF THE INVENTION

One of the advantages of the present invention is to provide a portable intrusion alarm system that requires no installation of sensors in the space being monitored.

Another advantage of the present invention is to provide such an intrusion alarm system that responds both to the low frequency pressure changes caused by the opening of doors and windows in accessing the monitored area, and to the high frequency pressure changes of breaking glass, while remaining unresponsive to normal, non-intrusive sounds.

Additional advantages of the invention will be set forth n part in the description which follows and in part will be obvious from the description, or may be learned by practice of the invention. The advantages of the invention may be realized and attained by means of the instrumentalities and combinations particularly pointed out in the appended claims.

To achieve the objects and in accordance with the purpose of the invention, as embodied and broadly described herein, the portable intrusion alarm system comprises a microphone operative to detect changes in ambient atmospheric pressure, low-frequency filter means responsive to the detected ambient pressure changes operative to generate an output at times when the frequency of the pressure changes correspond to the opening of either a door or window; first circuit means responsive to the output of the first low-frequency means operative to generate a first output signal upon the detected pressure changes reaching a first predetermined threshold; high frequency filter means responsive to the detected atmospheric pressure changes operative to generate an output at times when the frequency of the detected pressure changes correspond to the sound of breaking glass: second circuit means responsive to the output of the high frequency filter means operative to generate a second output signal upon the detected pressure changes reaching a second selected threshold; sensitivity circuit means responsive to the output of the low frequency filter means for decreasing effectively the second predetermined threshold; and alarm circuit means responsive to either one of the first and second output signals for generating a discernible alarm.

The accompanying drawings, which are incorporated in and constitute a part of this specification, illustrate one embodiment of the invention and, together with the description serve to explain the principles of the invention.

DETAILED DESCRIPTION OF THE PREFERRED EMBODIMENT

Reference will now be made in detail to the present preferred embodiment of the present invention, an example of which is illustrated in the accompanying drawings.

Figure 1:
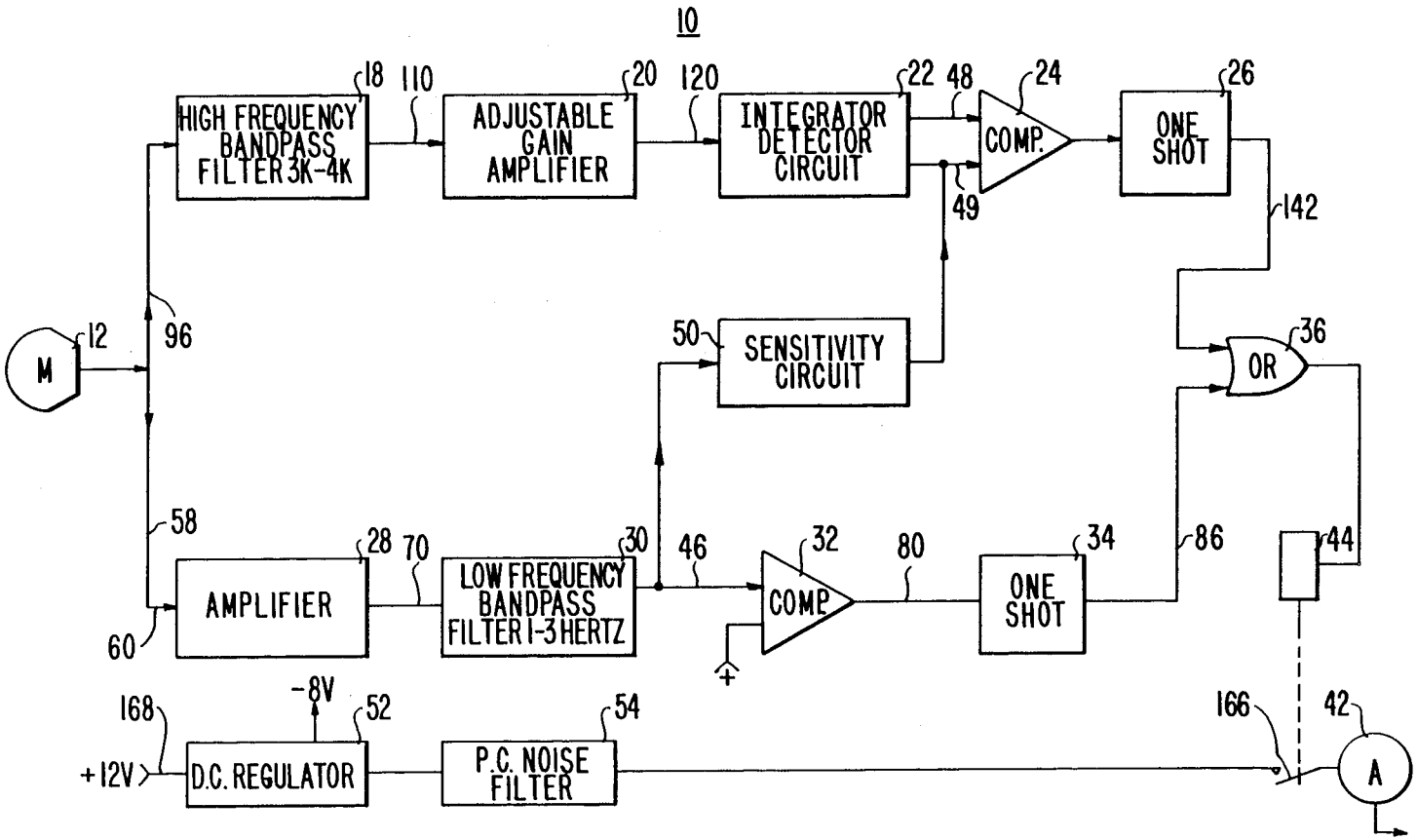
FIG. 1 is a schematic block diagram of a portable intrusion alarm system, in accordance with a preferred embodiment of the present invention.
Figure 2:
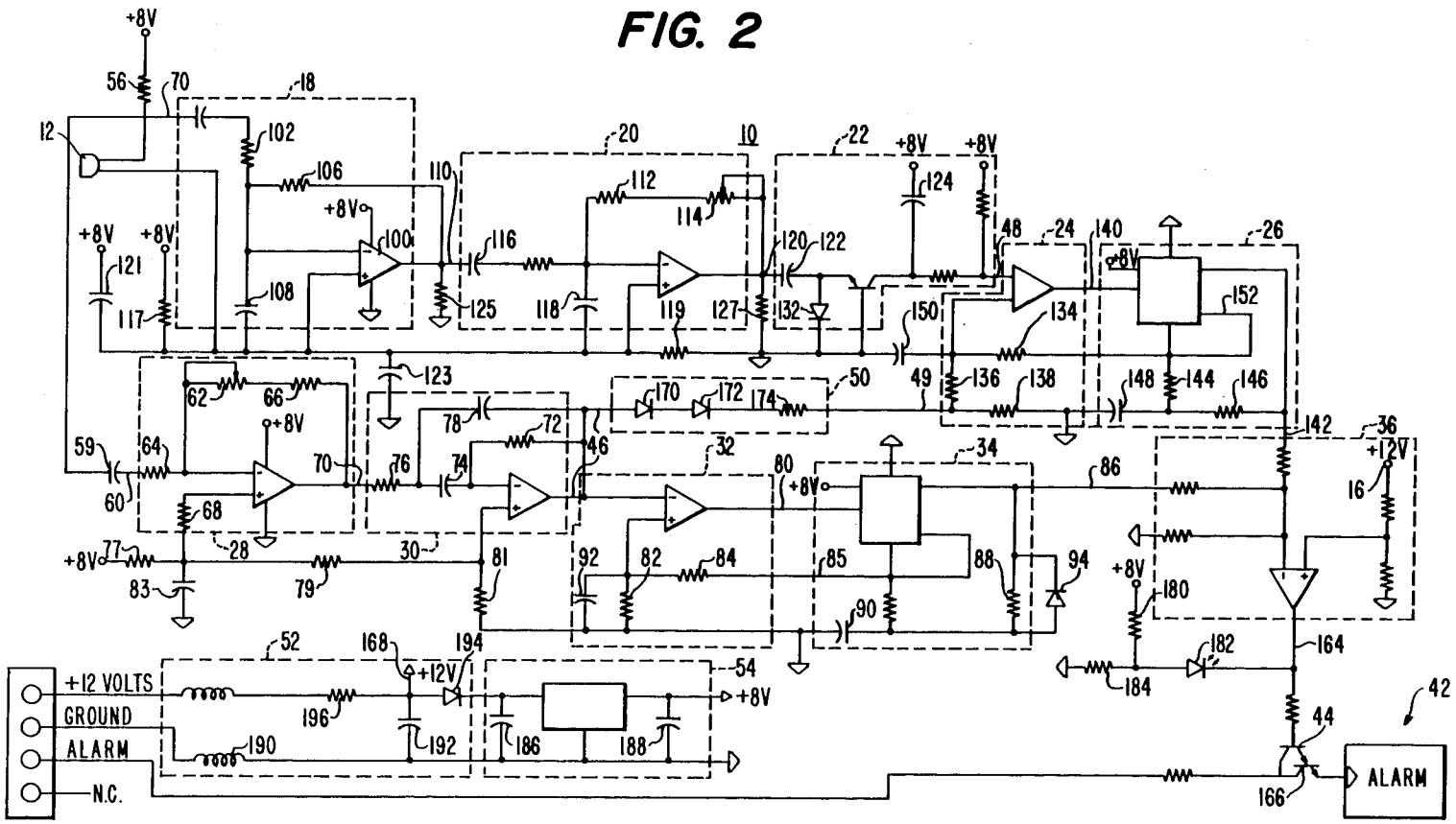
FIG. 2 is a detailed circuit diagram of the intrusion alarm system of FIG. 1.

The preferred embodiment of the portable intrusion alarm system is shown in FIGS. 1 and 2, and is represented generally by the numeral 10. Referring to the schematic block diagram of FIG. 1, alarm system 10 comprises a microphone 12, the output of which is divided into two parallel connected signal paths. Constituting one path is a bandpass filter circuit 18, an adjustable gain amplifier circuit 20, an integrator/detector circuit 22, a comparator circuit 24, and a one-shot multivibrator 26. The other path constitutes an amplifier circuit 28, a bandpass filter circuit 30, a comparator circuit 32, and a one-shot multivibrator 34. The two paths form inputs to an OR gate 36, the output of which controls alarm 42 through relay 44. Extending between output 46 of bandpass filter circuit 30 and output 48 of integrator/detector circuit 22 is a sensitivity circuit 50. A twelve volt source energizes alarm 42, and an eight volt source energizes the various aforementioned circuits through DC voltage regulator 52 and a DC noise filter 54.

In accordance with the present invention, system 10 comprises a microphone operative to detect changes in ambient atmospheric pressure. As herein embodied, and referring also to the detailed circuit diagram of FIG. 2, microphone 12, is preferably an omni-directional condenser type which has a high sensitivity, and signal-to-noise ratio, and is capable of detecting changes in air pressure from less than one cycle per second or one Hertz to in excess of four thousand cycles per second or 4 K Hertz. Bias current for the microphone is provided from an eight volt source through resistor 56. Such a microphone is well known, and is generally available from several manufacturers including *Mouser Electronics* of Mansfield, Tex.

The present invention also provides for a low frequency filter means responsive to detected ambient pressure changes operative to generate an output at times when the detected pressure changes have a frequency corresponding to the opening of either a window or door. As embodied herein microphone 12 has an output 58, which is connected through capacitor 59 to input 60 of amplifier 28. Capacitor 59, which isolates the DC signal on the microphone from the circuitry of amplifier 28, but is sufficiently high in capacity, such as 10 MF, to effectively couple the low frequencies of interest. Amplifier 28 is provided to amplify the low level signal from microphone 12 and includes a variable resistor 62, which may have a maximum resistance of 470K, so that the sensitivity of amplifier 28 to the microphone may be adjusted. Resistors 62, 64, and 68 which are each 100K, set the minimum sensitivity level of the amplifier. The amplified signal is applied to input 70 of low frequency bandpass filter 30 to output detected frequencies in the one and two Hertz range as shown by waveform 19 of FIG. 3. A resistor/capacitor circuit, which may comprise a one megohm resistor 72 and a 110 Mf capacitor 74 sets the low frequency cut-off of filter 30. An RC circuit, which may comprise a 4.7K resistor 76 and a one Mf capacitor 78, sets the high frequency cut-off. Resistors 77, which may be 1.8K, resistor 79, which may be 680 ohms, and resistor 81, which may be 1.8 ohms, constitute a voltage divider for setting the correct operating points for amplifier 28 and low frequency filter 30. Capacitor 83, which has a value 47 Mf, is a noise filter that requires a large value because of the low frequencies involved.

The invention includes a first circuit means responsive to the output of the low frequency filter operative to generate a first output signal upon the detected pressure change reaching a predetermined threshold. In the preferred embodiment illustrated herein, the first circuit means comprises comparator circuit 32 having its input connected to output 46 of filter 30; and a one-shot multivibrator 34 connected to output 80 of comparator circuit 32. When the voltage level on output 46 of filter circuit 30 decreases by a predetermined amount below the set level as determined by resistors 82 and 84, an output signal appears on output 80, which causes one-shot 34 to generate a single pulse on output 86. The width of the single pulse is determined by RC circuit resistor 88, which may be 100K, and capacitor 90, which may be 47 Mf. Capacitor 92 eliminates noise, and may have a value of 10 Mf. The output from comparator 32 on line 85 is applied through resistor 84 preventing any further alarm trips during the pulse time. Diode 94 discharges capacitor 90 after a predetermined delay, which resets one-shot 34 in readiness for another detection.

In accordance with the present invention, a high frequency filter means responsive to the detected atmospheric pressure change is operative to generate an output at times when the frequency of the detected pressure change corresponds to the sound of breaking glass. As embodied herein, output 96 of microphone 12, which is connected in parallel with output 58, serves as the input to high frequency bandpass filter 18. Filter 18 is centered around a frequency of three to four KHz to isolate the noise of breaking glass. Operational amplifier 100 replaces the signal lost in the filtering process. High frequency cut-off is determined by RC circuit comprising a 470K resistor 102 and a 0.01 Mf capacitor 104. Low frequency cut-off is determined by a 100K resistor 106 and a one Mf capacitor 108.

Filter 18 is connected at its output 110 to adjustable gain amplifier 20, which boosts the signal on 110 to a level sufficient to drive integrator detector circuit 22. Resistor 112, which may be 22K, sets the minimum gain and a variable resistor 114, which has a maximum resistance of 70K, adjusts tee gain. A 0.01 Mf capacitor 116 and a 100PF capacitor 118 eliminate high frequencies that could cause false alarms. Resistor 117, which may be 3.3K, and resistor 119, which may be 680 ohms, constitute a voltage divider that sets the operating point of integrator/detector circuit 22. Capacitor 121 and. 123 filter the set point to minimize the effect of noise. The capacitors may have a value of 0.01 Mf and 47 Mf, respectively. One kilohm resistors 125 and 127 add stability by keeping the output impedance of filter 18 and amplifier 20 low.

Figure 3:
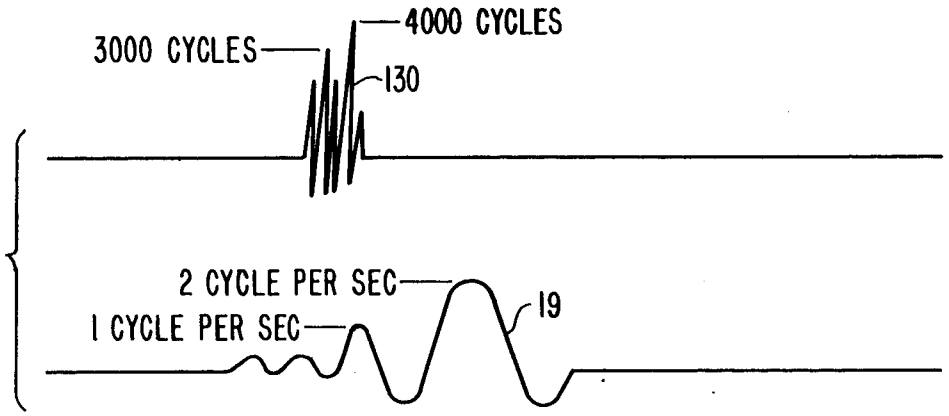
FIG. 3 is a graphical illustration of the output of the bandpass filters of FIG. 1 and 2.

In accordance with the invention, alarm system 10 comprises a second circuit means responsive to the output of the high frequency filter means operative to generate a second output signal upon the detected pressure changes attaining a second predetermined threshold. As embodied herein, the second circuit means includes integrator/detector circuit 22, which is coupled to amplifier 20 by line 120. Circuit 22 has a capacitor 122 at the input thereof, which may be 4700 Pf, and is normally charged. Each impulse from amplifier 20 on line 120 causes a portion of the charge on capacitor 122 to be transferred to capacitor 124, which in the described embodiment has a value of 47 Mf, through isolation transistor 126. Transistor 126 may be a 2N4401 type. The amount of the charge that is transferred is dependent on the strength and duration of the signal from amplifier 20, and of course, is limited by the amount of charge capacitor 124 can hold. After capacitor 124 is saturated, further impulses from amplifier 20 will provide a signal to comparator 24 of the proper level. Thus, a single impulse from amplifier 20 will not affect the output of the circuit 22. Several impulses are required similar to those obtained when clicking a fingernail over the teeth of a comb. As shown by FIG. 3 waveform 30 resembles breaking glass. Diode 132 limits the effect of positive going impulses from amplifier 20. The second circuit means also includes comparator 24 connected to output 48 of detector circuit 22. When the signal on line 48 goes below the level set by resistors 134, 136, and 138, which may have values of 33K, 22K, and 2.7K, respectively, an output signal is applied to one-shot multivibrator 26 on line 140. One shot multivibrator 26 provides a single output pulse on line 142, the width of which is determined by 10 K resistor 144, 100K resistor 146, and 47 Mf capacitor 148, for example. Capacitor 150 is a noise eliminator. The output on line 152 is low during the output pulse preventing any further alarm trips during the pulse time.

Output 142 from the breaking glass detector portion and output 86 from the door and window opening portion constitute the inputs to OR gate 36. Thus, either an opening of a door or window or the breaking of glass completes a circuit from twelve volt source 162, which causes operational amplifier output 164 to go from high to low, thus closing transistor switch 166. This causes switch 166 to conduct, which in turn completes a circuit from a twelve volt source 168, through DC regulator 52 and noise filter 54 for operating discernible alarm 42.

When the output on line 164 is in its normal high state, current is drawn through 220 ohm resistor 180 causing an LED 182 to indicate a green no alarm condition. When line 164 goes low, current is output through 120 ohm resistor 184 causing LED 182 to indicate a red alarm condition. Voltage regulator 52 supplies an eight volt potential for the various amplifier, filter and detector circuits of the alarm system. Capacitors 186 (100 mF) and 188 (47 mF) of voltage regulator circuit 54 filter noise, and prevent oscillations in the regulator. Inductances 190, and capacitor 192 (0.01), filter the input DC voltage to minimize noise effects. Diode 194 prevents damage in the event of an inadvertant reverse hook-up of the power: and resistor 196 acts like a fuse in the event of catastrophic failure in the circuit.

The amplitude of the noise of breaking of glass may be minimized by well known methods in an attempt to prevent detection, while the result of such breakage may produce the same low frequency response as opening a door or window, except with an amplitude insufficient to produce the required output signal. Thus, in accordance with the invention, the alarm system includes sensitivity circuit means responsive to the output of the low frequency filter means for effectively decreasing the second selected threshold. As embodied herein, a sensitivity circuit 50 comprising diodes 170 and 172 and a 10K resistor 174 are connected in series between line 46, that in turn connects the output of low frequency filter 30 to comparator 32, and line 49, that constitutes the reference input to comparison circuit 24. Circuit 50 applies a portion of the low frequency pressure detection output to decrease the predetermined threshold of the signal from the integrator/detector circuit 22 to comparator 24. Thus, when a pressure wave is detected, the glass break detector sensitivity is increased by an amount that corresponds to the amplitude of the pressure wave. It is not necessary that the strength of the low frequency wave be sufficient to cause an alarm independent of glass breakage, since the input to sensitivity circuit 50 is the input of the comparator.

It will be apparent to those skilled in the art that various modifications and variations can be made in the alarm system of the present invention without departing from the spirit or scope of the invention. Thus, it is intended that the present invention cover the modifications and variations provided they come within the scope of the appended claims and their equivalents.

What we claim is:

1. An intrusion alarm system, comprising:

a microphone operative to detect changes in ambient atmospheric pressure;

low frequency filter means responsive to the detected ambient pressure changes operative to generate an output at times when the frequency of the pressure changes correspond to the opening of either a door or window;

first circuit means responsive to the output of the low frequency filter means operative to generate a first output signal upon the detected pressure changes reaching a first predetermined threshold;

high frequency filter means responsive to the detected atmospheric pressure changes operative to generate an output at times when the frequency of the detected pressure changes correspond to the sound of breaking glass;

second circuit means responsive to the output of the high frequency filter means operative to generate a second output signal upon the detected pressure changes reaching a second predetermined threshold;

sensitivity circuit means responsive to the output of the low frequency filter means for decreasing effectively the second predetermined threshold; and alarm circuit means responsive to either one of the first and second output signals for generating a discernible alarm.

2. The alarm system of claim 1 wherein the low frequency filter means is a bandpass filter having a low cut-off frequency of approximately less than one Hertz and a high cut-off frequency of approximately two Hertz.

3. The alarm system of claim 1 wherein the high frequency filter means is operative to generate an output at times when the frequency of the pressure changes are in the range of approximately 3K to 4K Hertz.

4. The alarm system of claim 1 wherein the second circuit means, comprises capacitance means operative when charged a plurality of times in succession to generate the second output signal, said capacitance being charged in response to each cycle of the output of the high frequency filter means.

5. The alarm system of claim 1 wherein the first circuit means comprises, a comparator having a pair of inputs, one of said inputs being coupled to a reference voltage and another of said inputs being connected to the output of the low frequency filter means, said comparator being operative to generate the first output signal at times when the output of the low frequency filter means differs from the reference voltage by a predetermined level.

6. The alarm system of claim 1 wherein the second circuit means, comprises a comparator having a pair of inputs, one of said inputs being coupled to a reference voltage and another of said inputs being coupled to the output of the high frequency filter means, said comparator being operative to generate the second output signal at times when the output of the high frequency filter means differs from the reference voltage by a predetermined level.

7. An intrusion alarm system, comprising:

a microphone operative to detect changes in ambient atmospheric pressure;

low frequency filter means responsive to the detected ambient pressure changes operative to output signals having frequencies within a selected range;

first circuit means responsive to the output of the low frequency filter means operative to generate a first output signal upon the detected pressure changes reaching a first selected threshold;

high frequency filter means responsive to the detected atmospheric pressure changes operative to generate an output at times when the frequency of the detected pressure changes correspond to the sound of breaking glass;

second circuit means including capacitance means responsive to a plurality of successive outputs of the high frequency filter means operative to generate a signal indication of breaking glass, said high frequency circuit means being operative to generate a second output signal in response to the break signal reaching a level corresponding to a second predetermined threshold;

sensitivity circuit means responsive to the output of the low frequency filter means for decreasing the effective level of the second predetermined threshold; and alarm circuit means responsive to either one of the first and second output signals for generating a discernible alarm.

8. The alarm system of claim 7 wherein the sensitivity circuit means is coupled between the output of the low frequency filter means and the high frequency filter means.

9. The alarm system of claim 7 wherein the first filter means is a bandpass filter having a low cut-off frequency of approximately less than 1 Hertz and a high cut-off frequency of approximately 2 Hertz.

10. The alarm system of claim 9 wherein the second filter means is operative to generate an output at times when the frequency of the pressure changes are in the range of approximately 3K to 4K Hertz.

11. The alarm system of claim 10 wherein the second circuit means, comprises capacitance means operative when charged a predetermined number of times in succession to generate the second output signal, said capacitance being charged in response to each cycle of the output of the second filter means.

12. The alarm system of claim 11 wherein the first circuit means comprises, a comparator having a pair of inputs, one of said inputs being coupled to a reference voltage and another of said inputs being connected to the output of the first filter means, said comparator being operative to generate the first output signal at times when the output of the first filter means differs from the reference voltage by a selected level.

13. The alarm system of claim 12 wherein the second circuit means, comprises a comparator having a pair of inputs, one of said inputs being coupled to a reference voltage and another of said inputs being coupled to the output of the second filter means, said comparator being operative to generate the second output signal at times when the output of the second filter means differs from the reference voltage by a selected level.

* * * * *